US010071567B2

(12) United States Patent
Hirokawa et al.

(10) Patent No.: US 10,071,567 B2
(45) Date of Patent: Sep. 11, 2018

(54) INK JET RECORDING METHOD AND INK JET RECORDING APPARATUS

(71) Applicant: CANON KABUSHIKI KAISHA, Tokyo (JP)

(72) Inventors: Ryosuke Hirokawa, Kawasaki (JP); Akihiro Mouri, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/427,214

(22) Filed: Feb. 8, 2017

(65) Prior Publication Data

US 2017/0232762 A1 Aug. 17, 2017

(30) Foreign Application Priority Data

Feb. 15, 2016 (JP) ..... 2016-026418

(51) Int. Cl.

| | |
|---|---|
| ***B41J 11/00*** | (2006.01) |
| ***B41J 2/005*** | (2006.01) |
| ***B41J 2/01*** | (2006.01) |

(52) U.S. Cl.

CPC ..... *B41J 11/0015* (2013.01); *B41J 2/0057* (2013.01); *B41J 2/01* (2013.01); *B41J 2002/012* (2013.01)

(58) Field of Classification Search

CPC ..... B41J 11/0015; B41J 2/0057; B41J 2/01; B41J 2002/012

See application file for complete search history.

(56) References Cited

U.S. PATENT DOCUMENTS

| | | | | |
|---|---|---|---|---|
| 3,962,153 | A | 6/1976 | Gore | |
| 7,281,790 | B2 | 10/2007 | Mouri et al. | |
| 7,661,809 | B2 | 2/2010 | Taniuchi et al. | |
| 8,011,781 | B2 | 9/2011 | Taniuchi et al. | |
| 8,177,351 | B2 | 5/2012 | Taniuchi et al. | |
| 2014/0247302 | A1* | 9/2014 | Ohnishi | B41J 2/0057 347/21 |

FOREIGN PATENT DOCUMENTS

| | | | |
|---|---|---|---|
| JP | S50-022881 | A | 3/1975 |
| JP | S56-45773 | B2 | 10/1981 |
| JP | 2001-179959 | A | 7/2001 |
| JP | 2009-045851 | A | 3/2009 |

OTHER PUBLICATIONS

U.S. Appl. No. 15/427,214, filed Feb. 8, 2017, Hirokawa et al.

* cited by examiner

*Primary Examiner* — Geoffrey Mruk

(74) *Attorney, Agent, or Firm* — Fitzpatrick, Cella, Harper & Scinto

(57) ABSTRACT

An ink jet recording method includes an absorption/removal treatment of an aqueous liquid component by using a porous body from an image formed by using an ink and a reaction liquid that increases the viscosity of the ink. The ink contains at least two or more types of particles having different particle diameters, and the particles having different particle diameters satisfy the expressions (1) and (2):

$$D1/D2 \leq 0.5 \quad (1)$$

$$0.2 \leq M1/M2 \quad (2).$$

12 Claims, 7 Drawing Sheets

INK JET RECORDING METHOD AND INK JET RECORDING APPARATUS

BACKGROUND OF THE INVENTION

Field of the Invention

The present invention relates to an ink jet recording apparatus and an ink jet recording method.

Description of the Related Art

In an ink jet recording method, a liquid composition containing a coloring material (ink) is directly or indirectly applied onto a recording medium such as paper to form an image. During the process, the recording medium may excessively absorb a liquid component in the ink, thereby causing curing or cockling.

In order to immediately remove the liquid component in an ink from an image formed on a recording medium or a transfer body to suppress such trouble, there are a method of drying a recording medium by using warm air, infrared light, or a similar technique and a method in which an image is formed on a transfer body, then a liquid component contained in the image on the transfer body is dried by thermal energy or the like, and the image is transferred to a recording medium such as paper. Another method is disclosed as the technology of removing the liquid component contained in an image on a transfer body without using thermal energy. In the method, a roller-like porous body is brought into contact with an ink image to absorb and remove the liquid component from the ink image (Japanese Patent Application Laid-Open No. 2009-45851). Still another method of bringing a belt-like polymer absorber into contact with an ink image to absorb and remove a liquid component from the ink image is also disclosed (Japanese Patent Application Laid-Open No. 2001-179959).

SUMMARY OF THE INVENTION

The present invention is directed to providing an ink jet recording method and an ink jet recording apparatus enabling efficient removal of a liquid component from an image when a porous body is brought into contact with the image to remove the liquid component from the image.

According to an aspect of the present invention, there is provided an ink jet recording method including an image forming step of applying, to an ink receiving medium, an ink containing an aqueous liquid medium and a coloring material and a reaction liquid that increases a viscosity of the ink to form a first image containing an aqueous liquid component and the coloring material, and a liquid absorbing step of bringing a first face of a porous body of a liquid absorbing member into contact with the first image to allow the porous body to absorb at least a part of the aqueous liquid component from the first image.

The ink contains at least two or more types of particles different in average particle diameter, the particles different in average particle diameter include first particles and second particles, and the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink. According to another aspect of the present invention, there is provided an ink jet recording method including an image forming step of applying, to an ink receiving medium, an ink containing an aqueous liquid medium and a coloring material and a reaction liquid that increases a viscosity of the ink to form a first image containing an aqueous liquid component and the coloring material, and a liquid absorbing step of bringing a first face of a porous body of a liquid absorbing member into contact with the first image to concentrate the ink constituting the first image.

The ink contains at least two or more types of particles different in average particle diameter, the particles different in average particle diameter include first particles and second particles, and the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

According to still another aspect of the present invention, there is provided an ink jet recording apparatus including an image forming unit including an ink jet recording unit configured to apply an ink containing an aqueous liquid medium and a coloring material to an ink receiving medium and a reaction liquid applying unit configured to apply a reaction liquid that increases a viscosity of the ink, the image forming unit being configured to form a first image containing an aqueous liquid component and the coloring material, and a liquid absorbing unit including a liquid absorbing member, the liquid absorbing member including a porous body having a first face configured to come into contact with the first image, the porous body being configured to absorb at least a part of the aqueous liquid component from the first image.

The ink contains at least two or more types of particles different in average particle diameter, the particles different in average particle diameter include first particles and second particles, and the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

According to yet another aspect of the present invention, there is provided an ink jet recording apparatus including an image forming unit including an ink jet recording unit configured to apply an ink containing an aqueous liquid medium and a coloring material to an ink receiving medium and a reaction liquid applying unit configured to apply a reaction liquid that increases a viscosity of the ink, the image forming unit being configured to form a first image containing an aqueous liquid component and the coloring material, and a liquid absorbing unit including a liquid absorbing member, the liquid absorbing member including a porous body having a first face configured to come into contact with the first image to concentrate the ink constituting the first image.

The ink contains at least two or more types of particles different in average particle diameter, the particles different in average particle diameter include first particles and second particles, and the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

Further features of the present invention will become apparent from the following description of exemplary embodiments with reference to the attached drawings.

DESCRIPTION OF THE EMBODIMENTS

Figure 1:
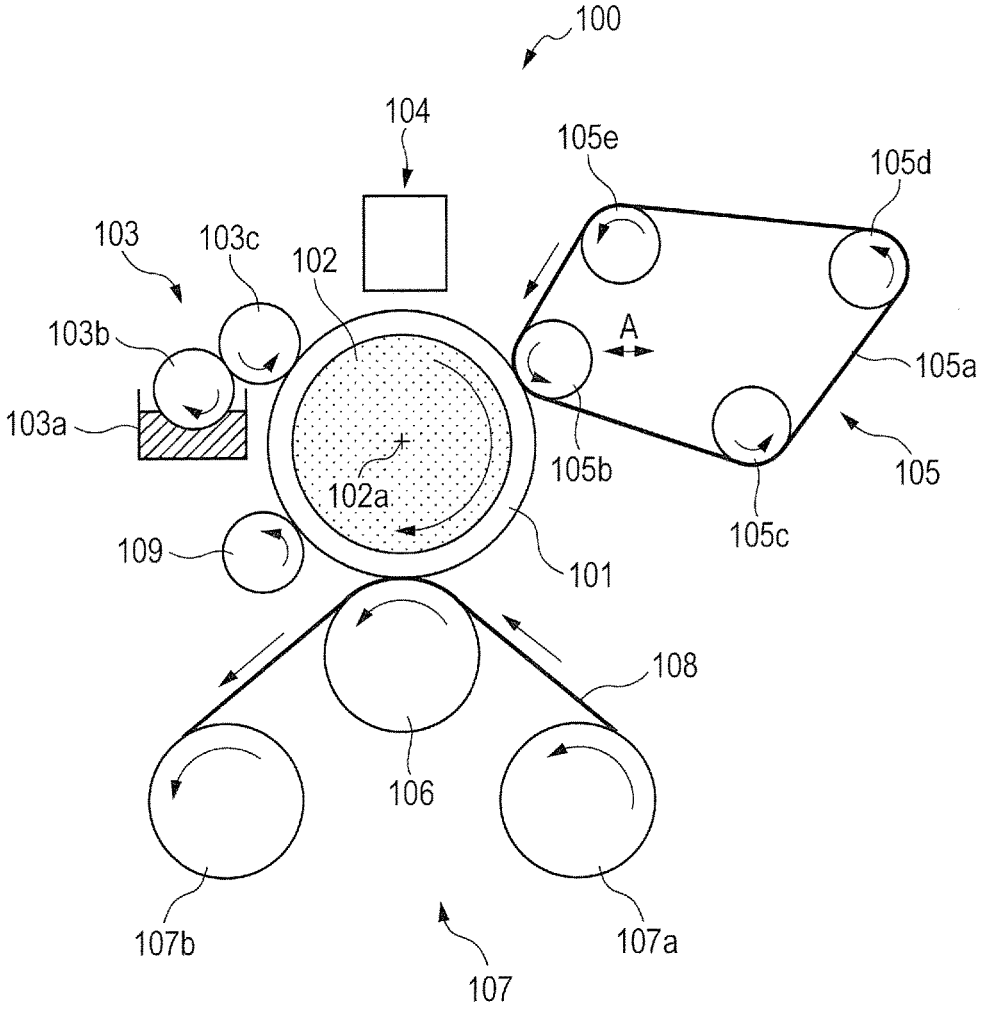
FIG. 1 is a schematic view showing an exemplary structure of a transfer type ink jet recording apparatus in accordance with the present invention.

Preferred embodiments of the present invention will now be described in detail in accordance with the accompanying drawings.

When the liquid component contained in images is removed by a porous body of a liquid absorbing member, the capillarity pressure of the porous body plays an important role. From an image containing a large amount of a liquid component, such a polymer absorber as disclosed in Japanese Patent Application Laid-Open No. 2001-179959 cannot satisfactory remove the liquid component in images in some cases.

When the porous body disclosed in Japanese Patent Application Laid-Open No. 2009-45851 is used for an image containing a large amount of a liquid component, especially for an image containing a large amount of a liquid component at the initial stage of image fixation immediately after the application of an ink onto a recording medium, only the capillarity pressure of the porous body may be insufficient for efficient absorption of the liquid component in the image. In particular, when formed by the image forming method in which an ink is reacted with a reaction liquid to form aggregates containing a coloring material in an image in order to suppress bleeding and beading, the image itself constitutionally has a capillary force due to the aggregates, and it is thus difficult to sufficiently remove the liquid component from the image by only the simple capillarity pressure of the porous body.

As a result of intensive studies for providing an ink jet recording method and an ink jet recording apparatus capable of efficiently removing a liquid component from an image when a porous body is brought into contact with the image to remove the liquid component from the image, the inventors of the present invention have accomplished the present invention.

An ink jet recording method of the present invention includes an image forming step of applying, to an ink receiving medium, an ink containing an aqueous liquid medium and a coloring material and a reaction liquid that increases the viscosity of the ink to form a first image containing an aqueous liquid component and the coloring material, and a liquid absorbing step of absorbing at least a part of the aqueous liquid component from the first image by a liquid absorbing member. The ink is applied to the ink receiving medium by an ink jet method.

The liquid absorbing member includes a porous body having an absorbability of an aqueous liquid component, and the porous body has a first face as a contact surface to come into contact with the first image. Through the first face of the porous body, at least a part of the aqueous liquid component contained in the first image is absorbed by the porous body.

The ink contains two or more types of particles different in average particle diameter, or two or more types of particles having different particle diameters. In the present invention, the two types or more particles different in average particle diameter includes first particles and second particles, the first particles have an average particle diameter of D1, the content of the first particles in the ink is M1, the second particles have an average particle diameter of D2, and the content of the second particles in the ink is M2. The particles satisfy the expressions (1) and (2).

$$D1/D2 \leq 0.5 \quad (1)$$

$$0.2 \leq M1/M2 \quad (2)$$

It is important that the ink contains at least one combination of the first particles and the second particles satisfying the expressions (1) and (2). For example, in addition to the combination of the first particles and the second particles satisfying the expressions (1) and (2), a combination of third particles and fourth particles satisfying the expressions (1) and (2) may be contained in the ink.

The combination of the first particles and the second particles satisfying the expression (1) and the expression (2) can be obtained by forming the first particles from at least either a pigment or resin particles and by forming the second particles from at least either a pigment or resin particles.

The image forming step preferably includes a step of applying a reaction liquid to an ink receiving medium and a step of applying an ink to the ink receiving medium. At the time of this application, the region to which the reaction liquid is applied at least partly overlaps with the region to which the ink is applied on the ink receiving medium. In other words, the reaction liquid preferably comes into contact with the ink on the ink receiving medium to form a first image. The order of the step of applying a reaction liquid to an ink receiving medium and the step of applying an ink to the ink receiving medium is not specifically limited, but from the viewpoint of improving the image quality of an image, the image forming step preferably includes the step of applying a reaction liquid to an ink receiving medium and the step of applying an ink to the ink receiving medium in this order. In other words, the image forming step preferably includes the step of applying a reaction liquid to an ink receiving medium and a step of applying an ink to the ink receiving medium so as to at least partly overlap with the region to which the reaction liquid has been applied, in the mentioned order.

An ink jet recording apparatus used in the ink jet recording method of the present invention includes an image forming unit configured to form a first image containing an aqueous liquid component and a coloring material and a liquid absorbing unit including a liquid absorbing member that includes a porous body configured to absorb at least a part of the aqueous liquid component from the first image.

The image forming unit includes an ink jet recording unit configured to apply an ink containing an aqueous liquid medium and a coloring material and a reaction liquid applying unit configured to apply a reaction liquid that increases the viscosity of the ink.

The ink contains at least two or more types of particles different in average particle diameter, and the particles different in average particle diameter include a combination of first particles and second particles satisfying the expressions (1) and (2).

The first particles are a mixture of a large number of particles having different particle diameters, and the second particles are also a mixture of a large number of particles having different particle diameters.

According to the present invention, by bringing the porous body of the liquid absorbing member into contact with the first image containing an aqueous liquid component and a coloring material on an ink receiving medium, at least a part of the aqueous liquid component is removed from the first image. This prevents a recording medium such as paper from excessively absorbing the aqueous liquid component in the first image, thereby suppressing curing or cockling.

In addition, the ink contains a combination of first particles and second particles satisfying the expressions (1) and (2), thus voids capable of holding the aqueous liquid component are reduced among ink aggregates contained in the first image, and this can help the porous body of the liquid absorbing member to efficiently absorb/remove the aqueous liquid component from the first image.

In the ink jet recording apparatus of the present invention, the image forming unit may be any image forming unit that enables the formation of a first image containing an aqueous liquid component and a coloring material on an ink receiving medium.

The image forming unit preferably includes 1) a device constituting a reaction liquid applying unit configured to apply a reaction liquid onto an ink receiving medium, and 2) a device constituting an ink jet recording unit configured to apply an ink containing an aqueous liquid medium and a coloring material onto the ink receiving medium.

The first image to be subjected to the liquid absorption treatment is formed by applying a reaction liquid and an ink to an ink receiving medium in such a manner as to give a region in which the reaction liquid at least overlaps with the ink. The reaction liquid improves the fixability of a coloring material applied together with the ink onto the ink receiving medium. The improvement in fixability of a coloring material means that an ink turns from the initial state in which the ink applied to an ink receiving medium has flowability into the state in which the flowability of the ink itself or of solid contents such as a coloring material in the ink is lowered by the action of a reaction liquid, thus the viscosity is increased, and the ink is unlikely to flow and is immobilized as compared with the initial state. The mechanism will be described later.

The first image is formed to contain a mixture of a reaction liquid and an ink. The ink contains a liquid medium containing at least water, or contains an aqueous liquid medium. The reaction liquid may also contain an aqueous liquid medium containing water, as needed. The first image contains an aqueous liquid component containing water derived from these aqueous liquid media together with the coloring material.

As the device of applying the ink onto an ink receiving medium, an ink jet recording device is used.

The reaction liquid can contain a component that chemically or physically interacts with an ink to viscously thicken a mixture of the reaction liquid and the ink as compared with each of the reaction liquid and the ink and improves the fixability of a coloring material. The reaction liquid can contain an aqueous liquid medium. The aqueous liquid medium contains at least water and may contain a water-soluble organic solvent or various additives, as needed.

At least one of the reaction liquid and the ink can contain a second liquid in addition to water as a first liquid. The second liquid may have any degree of volatility, but is preferably a liquid having a higher volatility than that of the first liquid.

An embodiment of the present invention will be described below.

In the following description, a "reaction liquid applying device" is used as the reaction liquid applying unit, an "ink applying device" is used as the ink jet recording unit, and a "liquid absorbing device" is used as the liquid absorbing unit. The first image is an ink image before the liquid removal in the liquid absorbing treatment, and the second image is an ink image after the liquid removal by the liquid absorbing treatment to reduce the content of the aqueous liquid component. The content of particles in an ink may be also called "particle amount".

<Reaction Liquid Applying Device>

The reaction liquid applying device may be any device capable of applying a reaction liquid onto an ink receiving medium, and hitherto known various devices can be appropriately used. Specific examples of the device include a gravure offset roller, an ink jet head, a die coating device (die coater), and a blade coating device (blade coater). The application of a reaction liquid by the reaction liquid applying device may be performed either before the application of an ink or after the application of an ink as long as the reaction liquid can be mixed (reacted) with an ink on an ink receiving medium. Preferably, the reaction liquid is applied before the application of an ink. The application of a reaction liquid before the application of an ink enables suppression of bleeding, which is caused by mixing of inks applied adjacent to each other, or beading, which is caused by pulling of a previously applied ink by a subsequently applied ink at the time of image recording by the ink jet system.

<Reaction Liquid>

The reaction liquid contains a component that increases the viscosity of an ink (ink-viscosity-increasing component). Here, the increase in viscosity of an ink is such a phenomenon that when a coloring material, a resin, or the like as a component constituting an ink comes into contact with an ink-viscosity-increasing component, the components are chemically reacted or physically adsorbed, and this causes an increase in viscosity of the ink.

The increase in viscosity of an ink includes not only an increase in viscosity of an ink but also a local increase in viscosity by aggregation of some of the components constituting an ink, such as a coloring material and a resin.

The ink-viscosity-increasing component has the effect of lowering the flowability of an ink and/or some of the components constituting an ink on an ink receiving medium to suppress bleeding or beading at the time of first image formation. In the present invention, increasing the viscosity of an ink is also called "viscously thickening an ink". As such an ink-viscosity-increasing component, polyvalent metal ions, organic acids, cation polymers, porous microparticles, and other known materials can be used. Specifically preferred are polyvalent metal ions and organic acids. A plurality of types of ink-viscosity-increasing components can also be preferably contained. The content of the ink-viscosity-increasing component in the reaction liquid is preferably 5% by mass or more relative to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid can contain water or a low volatile organic solvent in an appropriate amount as the aqueous liquid medium. The water used in this case is preferably a deionized water prepared by ion exchanging, for example. The organic solvent usable in the reaction liquid to be applied to the present invention is not limited to particular solvents, and a known organic solvent can be used.

To the reaction liquid, a surfactant or a viscosity modifier can be added to appropriately adjust the surface tension or the viscosity thereof, and such a reaction liquid can be used. The material to be used may be any material that can coexist with the ink-viscosity-increasing component. The surfactant specifically used is exemplified by an acetylene glycol ethylene oxide adduct ("Acetylenol E100" (trade name), manufactured by Kawaken Fine Chemicals), fluorochemical surfactants including a perfluoroalkyl ethylene oxide adduct (such as "MEGAFACE F444" (trade name), manufactured by DIC Corporation; "Capstone FS-3100" (trade name), manufactured by The Chemours Company, LLC; and Zonyl FS3100 (trade name), manufactured by DuPont), and silicone surfactants including a polyether modified polydimethylsiloxane adduct ("BYK349" (trade name), manufactured by BYK).

The aqueous liquid component produced by reacting an ink with a reaction liquid can be used as a wetting liquid (also called treatment liquid). In this case, the ink and/or the reaction liquid is so formulated as to give a mixture (aqueous liquid component) having a contact angle of less than 90° with respect to the first face of a water-repellent porous body. The contact angle of the mixture can be adjusted by selecting the type or the amount of the surfactant added to an ink and/or a reaction liquid.

<Ink Applying Device>

As the ink applying device for applying an ink, an ink jet head is used. The ink jet head is exemplified by a device that causes film boiling of an ink by an electrothermal converter to form bubbles and discharges the ink, a device that discharges an ink by an electromechanical converter, and a device that discharges an ink by using static electricity. In the present invention, any known ink jet head can be used. Of them, the device using an electrothermal converter can be suitably used, particularly from the viewpoint of high-density printing at high speed. To record an image, the head applies an intended amount of an ink to an intended position upon receiving an image signal.

The ink application amount can be expressed by image density (duty) or ink thickness. In the present invention, the mass of each ink dot is multiplied by the number of dots applied, and the result is divided by a printed area to give an average as the ink application amount ($g/m^2$) The maximum ink application amount in an image region represents an ink application amount in an area of at least 5 $mm^2$ or more within a region used as information of an ink receiving medium from the viewpoint of removing the liquid component in an ink.

The ink jet recording apparatus of the present invention can include a plurality of ink jet heads in order to apply inks of various colors on an ink receiving medium. For example, when a yellow ink, a magenta ink, a cyan ink, and a black ink are used to form a four-color image, the ink jet recording apparatus includes four ink jet heads that each discharge a corresponding ink of the four inks on an ink receiving medium.

The ink applying device may further includes an ink jet head that discharges an ink containing no coloring material (clear ink).

<Ink>

Each component of the ink applied to the present invention will be described.

(Coloring Material)

The coloring material contained in the ink applied to the present invention preferably contains a pigment. For example, the pigment or a mixture of a dye and the pigment can be used as the coloring material. The pigment usable as the coloring material is not limited to particular types. Specific examples of the pigment include inorganic pigments such as carbon black; and organic pigments such as azo pigments, phthalocyanine pigments, quinacridone pigments, isoindolinone pigments, imidazolone pigments, diketopyrrolopyrrole pigments, and dioxazine pigments. These pigments can be used singly or in combination of two or more thereof as needed.

The dye usable as the coloring material is not limited to particular types. Specific examples of the dye include direct dyes, acid dyes, basic dyes, disperse dyes, and food dyes, and a dye having an anionic group can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass or more to 15.0% by mass or less and more preferably 1.0% by mass or more to 10.0% by mass or less relative to the total mass of the ink.

The pigment as the coloring material preferably has an average particle diameter of 10 nm or more to 1,000 nm or less and more preferably an average particle diameter of 50 nm or more to 500 nm or less. These pigments can be used singly or in combination of two or more thereof as needed.

(Average Particle Diameters of First Particles and Second Particles and Contents of Particles in Ink)

In the present invention, the average particle diameters of the first particles and the second particles including a pigment and resin particles are determined by observing an ink under a scanning electron microscope (S4800 (trade name); manufactured by Hitachi High-Technologies Corporation; magnification: 50 K) and calculating the average of the diameters of observed 20 particles. The particle amount of the present invention (the content of particles) is the number of particles observed in an observation image region when an ink is observed under a scanning electron microscope (S4800 (trade name); manufactured by Hitachi High-Technologies Corporation; magnification: 50 K). The scanning electron microscope enables the distinction of observed particle types on the basis of differences in intensity of detected electrons. Hence, even when an ink containing, for example, a pigment as the first particles and resin particles as the second particles is directly observed, the respective average particle diameters of the first particles as the pigment and the second particles as the resin particles can be determined from the measurement result. Meanwhile, when the difference in intensity of detected electrons is not large between the first particles and the second particles and the types of particles are difficult to be distinguished, a dispersion containing the first particles used as a material of the ink and a dispersion containing the second particles used as a material of the ink were separately observed with a scanning electron microscope, and the average particle diameters and the contents of the respective particles were determined in the present invention.

(Dispersant)

As the dispersant for dispersing a pigment, a known dispersant used in an ink jet ink can be used. Specifically, a water-soluble dispersant having both a hydrophilic moiety and a water-repellent moiety in the structure is preferably used in an embodiment of the present invention. In particular, a pigment dispersant composed of a resin prepared by copolymerizing a mixture containing at least a hydrophilic monomer and a water-repellent monomer is preferably used. Each monomer used here is not limited to particular monomers, and known monomers are suitably used. Specifically, examples of the water-repellent monomer include styrene and other styrene derivatives, alkyl (meth)acrylates, and benzyl (meth)acrylate. Examples of the hydrophilic monomer include acrylic acid, methacrylic acid, and maleic acid.

The dispersant preferably has an acid value of 50 mg KOH/g or more to 550 mg KOH/g or less. The dispersant preferably has a weight average molecular weight of 1,000 or more to 50,000 or less. The mass ratio of the pigment and the dispersant (pigment:dispersant) is preferably within a range of 1:0.1 to 1:3.

The so-called self-dispersible pigment that is dispersible due to surface modification of a pigment itself and eliminates the use of the dispersant is also preferably used in the present invention.

(Resin Microparticles)

The ink applied to the present invention can contain various microparticles with no coloring material, and such an ink can be used. Specifically, resin microparticles may have the effect of improving image quality or fixability and are preferred. The material of the resin microparticles usable in the present invention is not limited to particular materials, and known resins can be appropriately used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylate, and polydiene; and copolymers prepared by copolymerizing a plurality of monomers, which are used for forming such a homopolymer, in combination.

The resin preferably has a weight average molecular weight (Mw) of 1,000 or more to 2,000,000 or less. In the ink, the content of the resin microparticles is preferably 1% by mass or more to 50% by mass or less and more preferably 2% by mass or more to 40% by mass or less relative to the total mass of the ink.

In an embodiment of the present invention, the resin microparticles are preferably used as a resin microparticle dispersion in which the resin microparticles are dispersed in a liquid. The dispersion technology is not limited to particular technologies. Preferred is the so-called self-dispersion type resin microparticle dispersion in which a resin prepared by homopolymerization of a monomer having a dissociable group or by copolymerization of a plurality of such monomers is dispersed. The dissociable group is exemplified by a carboxyl group, a sulfonic acid group, and a phosphoric acid group, and the monomer having such a dissociable group is exemplified by acrylic acid and methacrylic acid. In addition, the so-called emulsion-dispersion type resin microparticle dispersion in which resin microparticles are dispersed with an emulsifier can be similarly, suitably used in the present invention. As the emulsifier as used herein, a known surfactant is preferred regardless of having a low molecular weight or a high molecular weight. The surfactant is preferably a nonionic surfactant or a surfactant having the same charge as that of resin microparticles.

The resin microparticle dispersion used in an embodiment of the present invention preferably has a dispersion particle diameter of 10 nm or more to 1,000 nm or less and more preferably 50 nm or more to 500 nm or less.

When the resin microparticle dispersion used in an embodiment of the present invention is prepared, various additives are preferably added for stabilization. Examples of the additive include n-hexadecane, dodecyl methacrylate, stearyl methacrylate, chlorobenzene, dodecyl mercaptan, a blue dye (bluing agent), and polymethyl methacrylate.

(Surfactant)

The ink usable in the present invention may contain a surfactant. The surfactant is specifically exemplified by an acetylene glycol ethylene oxide adduct (Acetylenol E100 (trade name), manufactured by Kawaken Fine Chemicals). In the ink, the content of the surfactant is preferably 0.01% by mass or more to 5.0% by mass or less relative to the total mass of the ink.

Incidentally, as described in the section of reaction liquid, the ink and/or the reaction liquid can be formulated so that an aqueous liquid component produced by reacting the ink with the reaction liquid will have a contact angle of less than 90° with respect to the first face of a porous body. The contact angle of the mixture can be adjusted by selecting the type or the amount of a surfactant added to the ink and/or the reaction liquid.

(Water and Water-Soluble Organic Solvent)

The aqueous liquid medium in the ink is a liquid medium containing at least water. As the ink containing an aqueous liquid medium, or as the aqueous ink, an aqueous pigment ink containing at least a pigment as the coloring material can be used.

The aqueous liquid medium can further contain a water-soluble organic solvent as needed. The water is preferably a deionized water prepared by ion exchanging, for example. In the ink, the content of the water is preferably 30% by mass or more to 97% by mass or less relative to the total mass of the ink.

The type of the water-soluble organic solvent to be used is not limited to particular types, and any known organic solvent can be used. Specific examples of the water-soluble organic solvent include glycerol, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Needless to say, two or more solvents selected from these solvents can be used as a mixture.

In the ink, the content of the water-soluble organic solvent is preferably 3% by mass or more to 70% by mass or less relative to the total mass of the ink and is more preferably 50% by mass or more to 95% by mass or less relative to the total mass of the ink.

(Other Additives)

The ink usable in the present invention may contain, in addition to the above components, various additives such as a pH adjuster, an anticorrosive, an antiseptic agent, an antifungal agent, an antioxidant, a reduction inhibitor, a water-soluble resin and a neutralizer thereof, and a viscosity modifier, as needed.

<Liquid Absorbing Member>

In the present invention, at least a part of the aqueous liquid component is absorbed from a first image by bringing the liquid absorbing member including a porous body into contact, and thus the content of the liquid component in the first image is reduced. The contact surface of the liquid absorbing member with the first image is regarded as a first face, and the porous body is placed on the first face. Such a liquid absorbing member including the porous body preferably moves as the ink receiving medium moves, and preferably has such a shape that the liquid absorbing member rotates at a certain cycle after coming into contact with a first image, to come into contact with another first image and can absorb a liquid. The shape is exemplified by an endless-belt shape and a drum shape. The removal of the liquid component from an image by the liquid absorbing member enables suppression of image disturbances such as curing, cockling, and offset to a stacked paper caused by a remaining liquid component contained in an image, after transfer to a recording medium such as paper.

(Porous Body)

Porous body will be described below. In the present invention, the porous body has only to be a material having numerous pores. The porous body of the present invention includes a material having numerous pores formed by mutual crossing of fibers, for example. In order to suppress adhesion of the coloring material in an ink, the porous body preferably has a small pore diameter, and at least the porous body on the face (first face) that comes into contact with a first image preferably has a pore diameter of 10 μm or less. In order to improve the liquid component absorbability of the porous body, at least the porous body on the first face that comes into contact with an image preferably has an average pore diameter of 0.05 μm or more.

In the present invention, the pore diameter means an average diameter, and can be determined by a known technology such as a mercury intrusion method, a nitrogen adsorption method, and SEM image observation.

In order to evenly achieve high breathability, the porous body preferably has a small thickness. The breathability can be expressed as Gurley value in accordance with JIS P8117, and the Gurley value is preferably 10 seconds or less. The lower limit of the Gurley value is not limited to particular values, but can be 0.1 second or more, for example. The shape of the porous body is not limited to particular shapes, but is exemplified by a roller shape and a belt shape.

A thin porous body, however, cannot ensure a capacity sufficient to absorb a liquid component in some cases, and thus the porous body can have a multilayer structure. In the liquid absorbing member, only the layer to come into contact with an image on the transfer body is required to be a porous body, and a layer not to come into contact with an image on the transfer body is not necessarily a porous body.

The production process of the porous body is not specifically limited, and any production process hitherto widely used can be adopted. As an example, the specification of Japanese Patent No. 1114482 discloses a production process of a porous body by biaxial stretching of a resin containing polytetrafluoroethylene.

In the present invention, the porous body may be made from any material, and any of the hydrophilic materials having a contact angle with water of less than 90° and the water-repellent materials having a contact angle of 90° or more can be used.

When used, the hydrophilic material preferably has a contact angle with water of 40° or less. The hydrophilic material has the effect of sucking a liquid by capillary force.

The hydrophilic material is exemplified by polyolefins (including polyethylene (PE)), polyurethanes, nylons, polyamides, polyesters (including polyethylene terephthalate (PET)), and polysulfone (PSF).

The porous body is preferably water repellent from the viewpoint of improving releasability of the coloring material contained in a first image. In the present invention, the water-repellent porous body has a contact angle with water of 90° or more. As a result of intensive studies by the inventors of the present invention, it has been revealed that when a porous body having a contact angle with water of 90° or more is used, the adhesion of an ink coloring material to the porous body can be suppressed. The term "contact angle" herein employed refers to an angle between the surface of an object and the tangent line of a liquid drop at a position where the liquid drop is in contact with the object when a measurement liquid (such as water and a wetting liquid) is dropped onto the object (the first face of a porous body). Although the measurement technology includes some types, the inventors of the present invention measured the contact angle of the first face of a porous body in accordance with the technology described in "6. Sessile drop method" in JIS R3257. The water used as the measurement liquid is pure water (distilled water).

The water-repellent porous body may be made from any material that has a contact angle with water of 90° or more, but is preferably made from a water-repellent resin. The water-repellent resin is preferably a fluororesin. The fluororesin is specifically exemplified by polytetrafluoroethylene (hereinafter PTFE), polychlorotrifluoroethylene (PCTFE), polyvinylidene fluoride (PVDF), polyvinyl fluoride (PVF), perfluoroalkoxy fluororesin (PFA), a tetrafluoroethylene/hexafluoropropylene copolymer (FEP), an ethylene/tetrafluoroethylene copolymer (ETFE), and an ethylene/chlorotrifluoroethylene copolymer (ECTFE). These resins can be used singly or in combination of two or more thereof as needed. A plurality of films may be stacked. Of them, polytetrafluoroethylene is preferred.

<Multilayer Structure>

Next, an embodiment in which the porous body has a multilayer structure will be described. In this explanation, the layer on the side to come into contact with the first image is a first layer, and the layer stacked on the face opposite to the contact surface of the first layer with the first image is a second layer. For a structure including three or more layers, the layers are expressed in the laminating order successively from the first layer. In the present specification, the first layer is also called "absorbing layer", and the second and subsequent layers are also called "support layer".

[First Layer]

The first layer can be formed from the porous body previously described in the section of "(Porous body)".

In order to suppress coloring material adhesion and to improve cleanability, the above-described water-repellent porous body is preferably used as the first layer. Resins for the water-repellent porous body can be used singly or in combination of two or more thereof as needed. A plurality of films may be stacked in the first layer.

When composed of a water-repellent material, the first layer is preferably subjected to the pretreatment described later.

In the present invention, the first layer preferably has a film thickness of 50 μm or less, more preferably 30 μm or less, and even more preferably 1 μm or more to 30 μm or less. In examples of the present invention, the film thickness of each layer in the porous body was determined by measuring film thicknesses at any 10 points with a linear micrometer, OMV-25 (trade name; manufactured by Mitutoyo) and calculating the average.

The first layer can be produced by a known method for producing a thin porous film. For example, a resin material can be subjected to extrusion molding or a similar technology to give a sheet-like material, and the sheet-like material can be drawn into an intended thickness, yielding a first layer. Alternatively, a plasticizer such as paraffin can be added to the material for extrusion molding, and the plasticizer can be removed, for example, by heating at the time of drawing, yielding a porous film. The pore diameter can be adjusted by appropriately controlling the amount of a plasticizer added, the draw ratio, and the like.

[Second Layer]

In the present invention, the second layer is preferably a layer having breathability. Such a layer can be either a nonwoven fabric or a woven fabric of resin fibers. The second layer may be made from any material. In order to prevent the liquid absorbed by the first layer from flowing back, the contact angle of a preferred material with an aqueous liquid component absorbed from an image is equal to or lower than that of the first layer. Specifically, the material is preferably selected from raw materials such as polyolefins (including polyethylene (PE) and polypropylene (PP)), polyurethanes, nylons, polyamides, polyesters (including polyethylene terephthalate (PET)), and polysulfone (PSF), and composite materials thereof, for example. The second layer is preferably a layer having a larger pore diameter than that of the first layer.

[Third Layer]

In the present invention, the porous body having a multilayer structure may include three or more layers and is not limited. The third and subsequent layers are preferably a nonwoven fabric from the viewpoint of rigidity. As the material, a similar material to that for the second layer can be used.

[Other Materials]

The liquid absorbing member may include, in addition to the porous body having a multilayer structure, a reinforcing member that reinforces side faces of the liquid absorbing member. The liquid absorbing member may also include a joining member that joins the longitudinal ends of a long sheet-like porous body to form a belt-like member. For example, a non-porous tape material can be used as such a material and can be placed at a position or a cycle with which images do not come into contact.

[Production Method of Porous Body]

The method of stacking the first layer and the second layer to form the porous body may be any method. The layers can be simply overlaid or can be bonded to each other by a technology such as lamination by an adhesive agent or lamination by heating. From the viewpoint of breathability, lamination by heating is preferred in the present invention. Alternatively, the first layer or the second layer may be partly melted by heat, for example, and the layers may be adhesively laminated. A fusing material such as a hot melt powder may be interposed between the first layer and the second layer, and the layers may be adhesively laminated by heating. When a third or subsequent layer is stacked, layers may be stacked at once, or may be stacked successively. The stacking order is appropriately selected.

In the heating step, preferred is a lamination method in which porous bodies are heated while the porous bodies are interposed between heated rollers and pressed.

Next, a specific embodiment of the ink jet recording apparatus of the present invention will be described.

The ink jet recording apparatus of the present invention is exemplified by the following system apparatuses.

(A) An ink jet recording apparatus in which a first image is formed on a transfer body as the ink receiving medium and a second image after aqueous liquid component absorption by the liquid absorbing member is transferred to a recording medium.

(B) An ink jet recording apparatus in which a first image is formed on a recording medium as the ink receiving medium.

In the present invention, the former ink jet recording apparatus is called transfer type ink jet recording apparatus for convenience hereinafter, and the latter ink jet recording apparatus is called direct drawing type ink jet recording apparatus for convenience hereinafter.

Each ink jet recording apparatus will be described below.

(Transfer Type Ink Jet Recording Apparatus)

FIG. 1 is a schematic view showing an exemplary schematic structure of a transfer type ink jet recording apparatus 100 of the embodiment.

The transfer type ink jet recording apparatus 100 includes a transfer body 101 for temporarily holding a first image and a second image formed by removing at least a part of the aqueous liquid component from the first image. The transfer type ink jet recording apparatus 100 further includes a transfer unit including a pressing member for transferring 106 that transfers the second image onto a recording medium 108 on which an image is to be formed, or onto a recording medium for forming a final image depending on an intended purpose.

The transfer type ink jet recording apparatus includes the transfer body 101 supported by a support member 102, a reaction liquid applying device 103 for applying a reaction liquid onto the transfer body 101, an ink applying device 104 for applying an ink onto the transfer body 101 with the reaction liquid to form an ink image (first image) on the transfer body, a liquid absorbing device 105 for absorbing a liquid component from the first image on the transfer body, and the pressing member for transferring 106 for pressing a recording medium to transfer a second image from which the liquid component has been removed, on the transfer body onto the recording medium 108 such as paper. The liquid component is absorbed from the first image by the liquid absorbing device 105, and thus the first image on the transfer body is turned to a second image.

The transfer type ink jet recording apparatus 100 may further include a cleaning member 109 for a transfer body for cleaning the surface of the transfer body 101 after transfer of the second image onto the recording medium 108.

The support member 102 rotates around a rotating shaft 102*a* as the center in an arrow direction in FIG. 1. By rotating the support member 102, the transfer body 101 moves rotatively. On the moving transfer body 101, a reaction liquid and an ink are sequentially applied by the reaction liquid applying device 103 and the ink applying device 104, respectively, and a first image is formed on the transfer body 101. As the transfer body 101 moves, the first image formed on the transfer body 101 moves to the position at which a liquid absorbing member 105*a* of the liquid absorbing device 105 comes into contact.

The liquid absorbing member 105*a* of the liquid absorbing device 105 synchronizes with the rotation of the transfer body 101. The first image formed on the transfer body 101 undergoes the state of contact with the moving liquid absorbing member 105*a*. During the contact state, the liquid absorbing member 105*a* removes a liquid component containing at least an aqueous liquid component from the first image.

By subjecting the first image to the state of contact with the liquid absorbing member 105*a*, the liquid component contained in the first image is removed. In the state of contact, the liquid absorbing member 105*a* is preferably pressed against the first image at a certain pressing force for helping the liquid absorbing member 105*a* to function effectively.

The removal of the liquid component can be expressed from a different point of view as concentrating the ink constituting the image formed on the transfer body. Concentrating the ink means that the proportion of the solid content contained in the ink, such as coloring material and resin, with respect to the liquid component contained in the ink increases owing to reduction in the liquid component.

As the transfer body 101 moves, the image (second image) after removal of the liquid component moves to a transfer unit at which the image comes into contact with a recording medium 108 conveyed by a recording medium conveyance device 107. The second image after removal of the liquid component is transferred onto the recording medium 108. The ink image after transfer onto the recording medium 108 is a reverse image of the second image. In the following description, the ink image after transfer is also called third image, separately from the first image (ink image before liquid removal) and the second image (ink image after liquid removal) described above.

On the transfer body, the reaction liquid is applied, and then the ink is applied to form the image. Thus, the reaction liquid is not reacted with the ink and is left in a non-image region (no ink image formation region). In the apparatus, the liquid absorbing member 105*a* comes into contact (pressure contact) with not only the image but also the unreacted reaction liquid and removes also a liquid component in the reaction liquid from the surface of the transfer body 101.

Although the above description expresses that the liquid component is removed from the image, the expression is not limited to removal of the liquid component only from the image, but means that the liquid component is removed at least from the image on the transfer body. For example, the liquid component in the reaction liquid applied to a region outside the first image can be removed together from the first image.

The liquid component may be any liquid component that does not have a certain shape and have flowability and a substantially constant volume.

The liquid component is exemplified by water and an organic solvent contained in an ink or a reaction liquid.

Even when the clear ink is contained in a first image, the ink can be concentrated by the liquid absorption treatment. For example, when a clear ink is applied onto a color ink containing a coloring material applied onto the transfer body 101, the clear ink is present on the whole surface of the first image, or the clear ink is partly present at a position or a plurality positions on the surface of the first image and the color ink is present at the other positions. At the positions at which the clear ink is present on the color ink in the first image, the porous body absorbs the liquid component in the clear ink on the surface of the first image, and the liquid component in the clear ink moves. Accordingly, the liquid component in the color ink also moves to the porous body, and thus the aqueous liquid component in the color ink is absorbed.

Meanwhile, in the area in which clear ink regions and color ink regions are present on the surface of the first image, the respective liquid components of the color ink and the clear ink move to the porous body, and the aqueous liquid components are absorbed. The clear ink may contain a large amount of a component for improving the transferability of an image from the transfer body 101 to a recording medium. For example, the proportion of a component having such a stickiness to a recording medium as to be increased by heat as compared with a color ink can be increased.

Components constituting the transfer type ink jet recording apparatus of the embodiment will be described below.

<Transfer Body>

The transfer body 101 includes a surface layer having an image formation surface. As the material for the surface layer, various materials such as resins and ceramics can be appropriately used, but a material having a high compressive elastic modulus is preferred from the viewpoint of durability and the like. Specifically exemplified are an acrylic resin, an acrylic silicone resin, a fluorine-containing resin, and a condensate prepared by condensation of a hydrolyzable organic silicon compound. In order to improve the wettability of a reaction liquid, transferability, and the like, surface treatment may be performed. The surface treatment is exemplified by flame treatment, corona treatment, plasma treatment, polishing treatment, roughening treatment, active energy ray-irradiation treatment, ozone treatment, surfactant treatment, and silane coupling treatment. These treatments may be performed in combination. Any surface shape may be provided on the surface layer.

The transfer body preferably includes a compressible layer having such a function as to absorb pressure fluctuations. A provided compressible layer absorbs deformation to disperse local pressure fluctuations, and satisfactory transferability can be maintained even during high speed printing. The material for the compressible layer is exemplified by acrylonitrile-butadiene rubber, acrylic rubber, chloroprene rubber, urethane rubber, and silicone rubber. It is preferred that when such a rubber material is molded, predetermined amounts of a vulcanizing agent, a vulcanization accelerator, and the like be added, and a foaming agent, hollow microparticles, or a filler such as sodium chloride be further added as needed to form a porous material. In such a porous compressible layer, bubble portions are compressed with volume changes against various pressure fluctuations, thus deformation except in a compression direction is small, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The transfer body preferably further includes an elastic layer between the surface layer and the compressible layer. As the material for the elastic layer, various materials such as resins and ceramics can be appropriately used. From the viewpoint of processing characteristics and the like, various elastomer materials and rubber materials are preferably used. Specific examples include fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers, and nitrile-butadiene rubber. Specifically, silicone rubber, fluorosilicone rubber, and phenylsilicone rubber, which have a small compress set, are preferred from the viewpoint of dimensional stability and durability. The temperature change in elastic modulus of such a material is small, and thus the above materials are preferred from the viewpoint of transferability.

Between the layers constituting the transfer body (the surface layer, the elastic layer, and the compressible layer), various adhesives or double-sided adhesive tapes may be interposed in order to fix/hold the layers. The transfer body may also include a reinforcing layer having a high compressive elastic modulus in order to suppress lateral elongation when installed in an apparatus or to maintain resilience. A woven fabric may be used as the reinforcing layer. The transfer body can be prepared by combination of any layers made from the above materials.

The size of the transfer body can be freely selected depending on the size of an intended print image. The shape of the transfer body may be any shape and is specifically exemplified by a sheet shape, a roller shape, a belt shape, and an endless web shape.

<Support Member>

The transfer body 101 is supported on a support member 102. As the supporting manner of the transfer body, various adhesives or double-sided adhesive tapes may be used. Alternatively, by attaching an installing member made from a metal, ceramics, a resin, or the like to the transfer body, the transfer body may be supported on the support member 102 by using the installing member.

The support member 102 is required to have a certain structural strength from the viewpoint of conveyance accuracy and durability. As the material for the support member, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. It is also preferred to use these materials in combination.

<Reaction Liquid Applying Device>

The ink jet recording apparatus of the embodiment includes a reaction liquid applying device 103 for applying a reaction liquid onto the transfer body 101. The reaction liquid applying device 103 in FIG. 1 shows the case of a gravure offset roller including a reaction liquid storage unit 103*a* for storing a reaction liquid and reaction liquid applying members 103*b*, 103*c* for applying the reaction liquid in the reaction liquid storage unit 103*a* onto the transfer body 101.

<Ink Applying Device>

The ink jet recording apparatus of the embodiment includes an ink applying device 104 for applying an ink onto the transfer body 101 onto which the reaction liquid has been applied. The reaction liquid and the ink are mixed to form a first image, and a liquid component is absorbed from the first image by the subsequent liquid absorbing device 105.

<Liquid Absorbing Device>

In the present embodiment, the liquid absorbing device 105 includes a liquid absorbing member 105*a* and a pressing member 105*b* for liquid absorption for pressing the liquid absorbing member 105*a* against a first image on the transfer body 101.

As shown in FIG. 1, the pressing member 105*b* functions to press the second face as the back face of the first face of the liquid absorbing member 105*a*, thereby bringing the first face into contact with the circumference surface of the transfer body 101. By passing the first image through a nip formed by the contact, the liquid absorption treatment from the first image can be performed. The region against which the liquid absorbing member 105*a* is pressed to enable pressure contact of the liquid absorbing member 105*a* with the circumference surface of the transfer body 101 is used as a liquid absorption treatment region.

The position of the pressing member 105*b* relative to the transfer body 101 and the pressure against the transfer body 101 can be controlled by position control and a pressure mechanism (not shown in the drawings). For example, a pressing member 105*b* capable of reciprocating in the double-headed arrow direction A shown in the figure can be used to bring the liquid absorbing member 105*a* into contact with the circumference surface of the transfer body 101 at the timing when the liquid absorption treatment is required, and the liquid absorbing member 105*a* can be separated from the circumference surface.

The liquid absorbing member 105*a* and the pressing member 105*b* may have any shape. Such a configuration as shown in FIG. 1 is exemplified. In the configuration, the pressing member 105*b* has a column shape, the liquid absorbing member 105*a* has a belt shape, and the column-like pressing member 105*b* presses the belt-like liquid absorbing member 105*a* against the transfer body 101. In another exemplified configuration, the pressing member 105*b* has a column shape, the liquid absorbing member 105*a* has a hollow column shape formed on the peripheral surface of the pressing member 105*b*, and the column-like pressing member 105*b* presses the hollow column-like liquid absorbing member 105*a* against the transfer body.

In the present invention, the liquid absorbing member 105*a* preferably has a belt shape in consideration of the space in the ink jet recording apparatus, for example.

The liquid absorbing device 105 including such a belt-like liquid absorbing member 105*a* may also include extending members for extending the liquid absorbing member 105*a*. In FIGS. 1, 105*c*, 105*d*, and 105*e* are extending rollers as the extending members. These rollers and a belt-like liquid absorbing member 105*a* extended by the rollers constitute a conveyance unit that conveys the porous body for the liquid absorption treatment from a first image. The conveyance unit enables carrying-in, carrying-out, and re-carrying of the porous body to and from the liquid absorption treatment region.

In FIG. 1, the pressing member 105*b* is also a roller member rotating as with the extending rollers, but is not limited to this.

In the liquid absorbing device 105, the liquid absorbing member 105*a* including a porous body is pressed (brought) by the pressing member 105*b* against (into pressure contact with) a first image to allow the liquid absorbing member 105*a* to absorb a liquid component contained in the first image, thereby removing the liquid component from the first image. As the method of removing the liquid component in the first image, the present system of pressing the liquid absorbing member may be combined with other various technologies hitherto used, such as a heating method, a method of blowing air with low humidity, and a decompression method.

Various conditions and components of the liquid absorbing device 105 will be described in detail below.

(Pretreatment)

Figure 2:
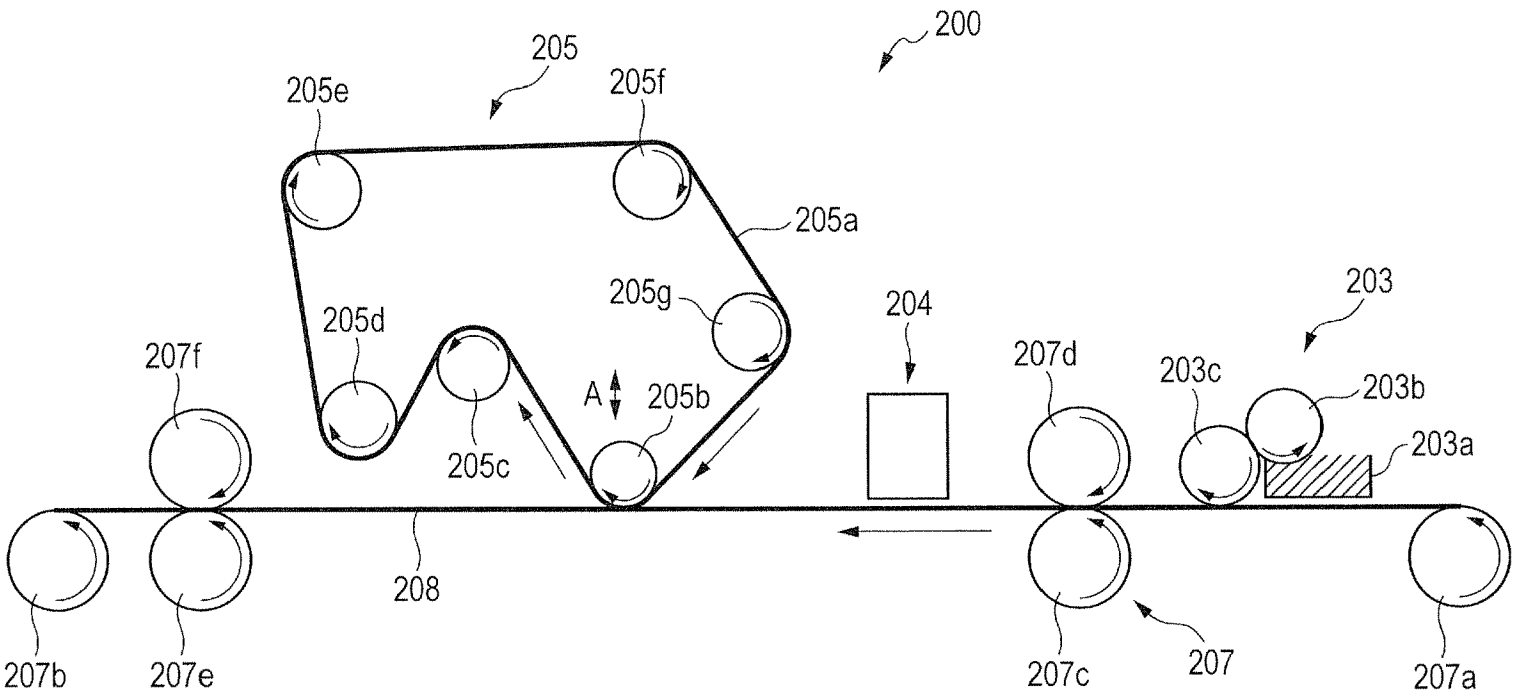
FIG. 2 is a schematic view showing an exemplary structure of a direct drawing type ink jet recording apparatus in accordance with the present invention.

Before the liquid absorbing member including a porous body is brought into contact with an image, the liquid absorbing member is preferably subjected to pretreatment with a pretreatment unit to apply a wetting liquid (not shown in FIGS. 1 and 2). The wetting liquid preferably contains water and a water-soluble organic solvent. The water is preferably a deionized water prepared by ion exchanging, for example. The water-soluble organic solvent is not limited to particular types, and any known organic solvent such as ethanol and isopropyl alcohol can be used. In the pretreatment of the liquid absorbing member used in the present invention, the application method of a wetting liquid to a porous body may be any method, but immersing or liquid dropping is preferred.

(Pressing Conditions)

The pressure (contact pressure P) of the liquid absorbing member pressing against a first image on the transfer body is preferably 0.15 MPa or more because the liquid component in the first image can be separated by solid-liquid separation for a shorter time and the liquid component can be removed from the first image. The pressure is preferably 1.0 MPa or less because the structural load on an apparatus is suppressed. The pressure of a liquid absorbing member in the present invention represents the nip pressure between a transfer body 101 and a liquid absorbing member 105*a*, and is the value determined by the following procedure. A surface pressure distribution measuring device (I-SCAN (trade name), manufactured by Nitta) is used to perform surface pressure measurement, and the load in a pressed region is divided by the area, giving the pressure.

(Application Time)

The application time for contact of the liquid absorbing member 105*a* with an image is preferably within 50 ms (milliseconds) in order to further suppress adhesion of the coloring material in the image to the liquid absorbing member. The application time is preferably 3 ms or more because the liquid absorbing member 105*a* can be stably in contact with a first image. In the present invention, the application time is calculated by dividing the pressure detection width in a movement direction of the transfer body 101 in the above surface pressure measurement by the movement speed of the transfer body 101. Hereinafter, the application time is called liquid absorbing nip time.

(Effect by Combination of Particles Different in Average Particle Diameter)

Figure 3A:
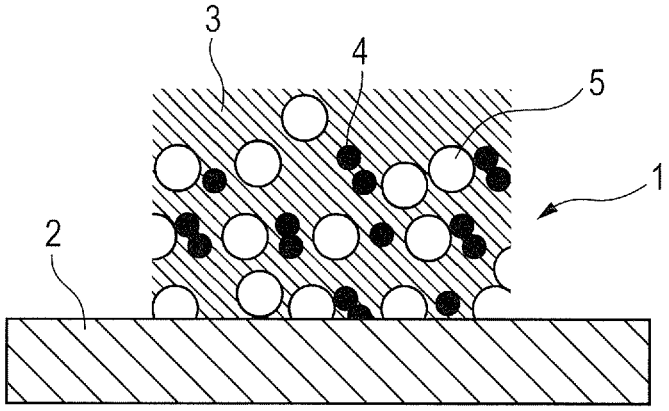
FIGS. 3A and 3B are schematic sectional views of images (containing ink aggregates) before and after absorption/removal of the liquid component contained in an image.
Figure 3B:
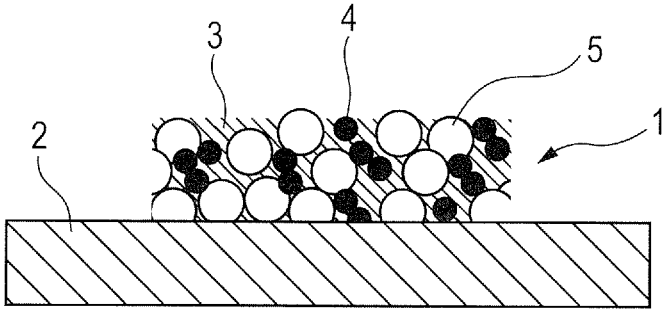

FIGS. 3A and 3B are schematic views showing the states of exemplary images (ink aggregates). FIGS. 3A and 3B show the states of images formed on a transfer body 101 as schematic, partial sectional views. In FIGS. 3A and 3B, 1 is an image (ink aggregates), 2 is an ink receiving medium, 3 is a liquid component, 4 is a first particle (a pigment (a coloring material) or a resin particle), and 5 is a second particle (a pigment (a coloring material) or a resin particle). FIG. 3A shows a first image before absorption of the liquid component contained in the image by a liquid absorbing member, and FIG. 3B shows a second image after absorption/removal of the liquid component contained in the image by a liquid absorbing member. It is supposed that by bringing (pressing) a liquid absorbing member including a porous body into pressure contact with (against) an image containing a large amount of a liquid component 3 as shown in FIG. 3A, the liquid component 3 can be absorbed/removed while the liquid component is extruded from voids among particles (a pigment or resin microparticles).

Figure 4A:
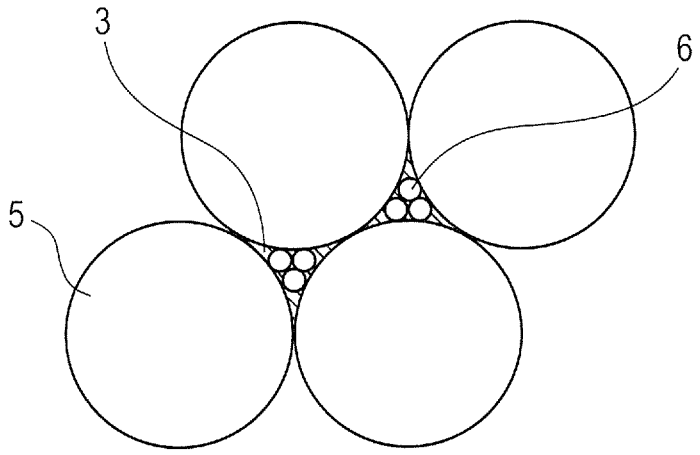
FIGS. 4A and 4B are enlarged schematic views showing the states of ink aggregates after absorption/removal of the liquid component contained in an image.
Figure 4B:
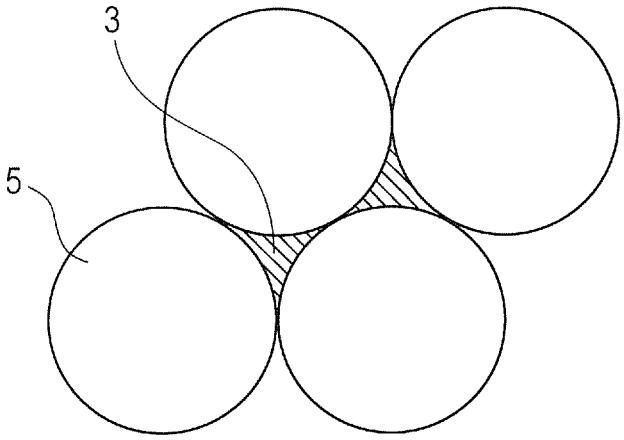

FIGS. 4A and 4B are enlarged schematic views showing the states of aggregates contained in second images after absorption/removal of the liquid component contained in the images by a liquid absorbing member. In FIGS. 4A and 4B, 3 is a liquid component, 5 is a second particle (a pigment (a coloring material) or resin particle), and 6 is a first particle (a coloring material (a pigment) or a resin particle). When the ink of the present invention contains two types of particles having average particle diameters (D1 and D2) shown in FIG. 4A at certain contents (M1 and M2), the packing density of the particles is increased in the image as compared with an ink containing a single type of particles shown in FIG. 4B. As the particle packing density increases, voids where a liquid component is present among particles is reduced in an image, and the liquid component is likely to be extruded from the image, or the liquid component is unlikely to be left in the image. Consequently, high performance of absorbing/removing a liquid component can be achieved.

(Liquid Removal Method from Liquid Absorbing Member)

The liquid component absorbed from images by the liquid absorbing member can be removed from the liquid absorbing member 105*a* by a known technology. The technology is exemplified by a heating method, a method of blowing air with low humidity, a decompression method, and a method of squeezing a porous body.

In this manner, a second image in which the liquid component is absorbed from the first image to reduce the liquid component is formed on the transfer body 101. The second image is transferred onto a recording medium 108 by the subsequent transfer unit. The device configuration and conditions for transfer will be described.

<Pressing Member for Transferring>

In the present embodiment, during contact of the second image with a recording medium 108 conveyed by a recording medium conveyance device 107, a pressing member for transferring 106 presses the recording medium 108, thereby transferring the ink image onto the recording medium 108. The liquid component contained in the first image on the transfer body 101 is removed, then the image is transferred onto the recording medium 108, and consequently a recorded image prevented from causing curing, cockling, and the like can be produced. As the pressing member for transferring, a transfer roller can be preferably used.

The pressing member 106 is required to have a certain structural strength from the viewpoint of the conveyance accuracy of a recording medium 108 and durability. As the material for the pressing member 106, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. These materials may be used in combination.

The pressing time of the pressing member 106 for transferring a second image on the transfer body 101 to a recording medium 108 is not limited to particular values, but is preferably 5 ms or more to 100 ms or less in order to satisfactorily transfer the image and not to degrade the durability of the transfer body. The pressing time in the embodiment represents the time during the contact of a recording medium 108 with a transfer body 101 and is the value determined by the following procedure. A surface pressure distribution measuring device (I-SCAN (trade name), manufactured by Nitta) is used to perform surface pressure measurement, and the length in the conveyance direction of a pressed region is divided by the conveyance speed, giving the pressing time.

The pressure by the pressing member 106 for transferring a second image on the transfer body 101 to a recording medium 108 is not limited to particular values, but is controlled so as to satisfactorily transfer the image and not to degrade the durability of the transfer body. Thus, the pressure is preferably 9.8 $N/cm^2$ (1 $kg/cm^2$) or more to 294.2 $N/cm^2$ (30 $kg/cm^2$) or less. The pressure in the embodiment represents the nip pressure between a recording medium 108 and a transfer body 101, and is a value determined by the following procedure. A surface pressure distribution measuring device is used to perform surface pressure measurement, and the load in a pressed region is divided by the area, giving the pressure.

The temperature during pressing by the pressing member 106 for transferring a second image on the transfer body 101 to a recording medium 108 is also not limited to particular values, but is preferably not lower than the glass transition point or not lower than the softening point of the resin component contained in an ink. A preferred embodiment for heating includes a heating device for heating a second image on the transfer body 101, the transfer body 101, and a recording medium 108.

The shape of the pressing member for transferring 106 is not limited to particular shapes, but is exemplified by a roller shape.

<Recording Medium and Recording Medium Conveyance Device>

In the present embodiment, the recording medium 108 is not limited to particular media, and any known recording medium can be used. The recording medium is exemplified by long media rolled into a roll and sheet media cut into a certain size. The material is exemplified by paper, plastic films, wooded boards, corrugated cardboard, and metal films.

In FIG. 1, the recording medium conveyance device 107 for conveying the recording medium 108 is composed of a recording medium delivery roller 107*a* and a recording medium winding roller 107*b*, but may be composed of any members capable of conveying a recording medium, and is not specifically limited to the structure.

<Control System>

Figure 5:
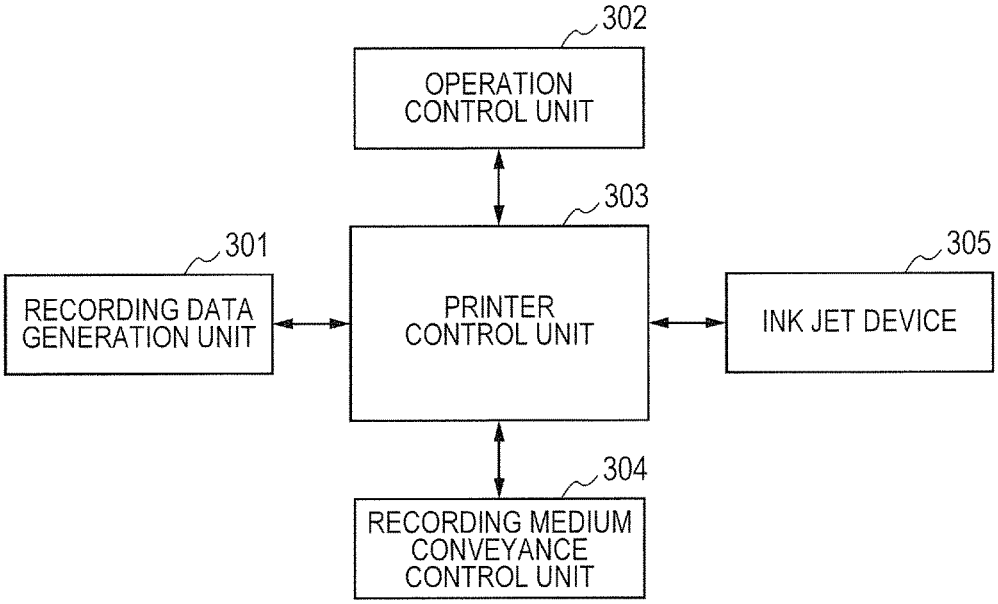
FIG. 5 is a block diagram of a control system for the whole ink jet recording apparatuses shown in FIGS. 1 and 2.

The transfer type ink jet recording apparatus in the embodiment has a control system for controlling each device. FIG. 5 is a block diagram of a control system for the whole transfer type ink jet recording apparatus shown in FIG. 1.

In FIG. 5, 301 is a recording data generation unit such as an external print server, 302 is an operation control unit such as an operation panel, 303 is a printer control unit for executing a recording process, 304 is a recording medium conveyance control unit for conveying a recording medium, and 305 is an ink jet device for printing.

Figure 6:
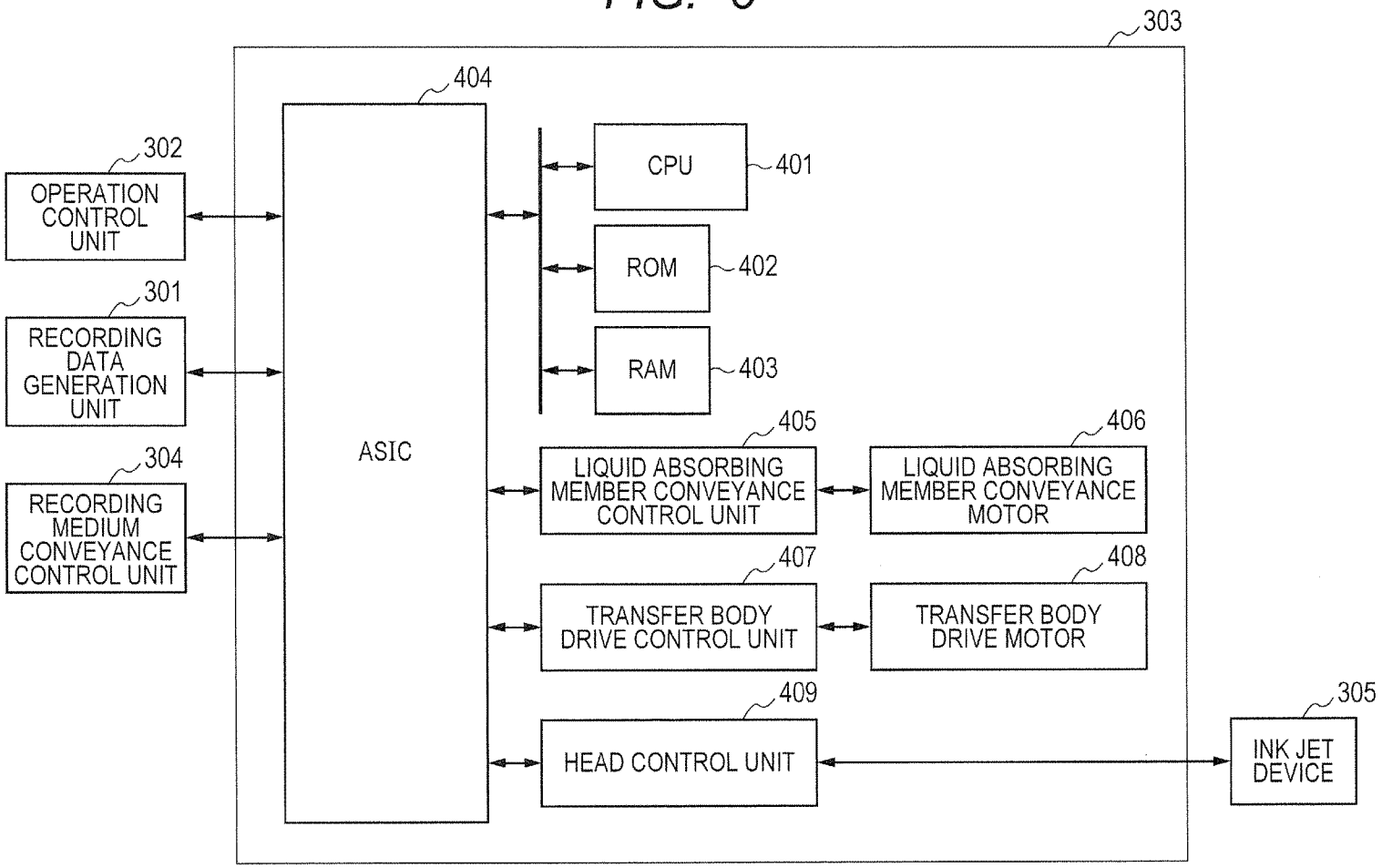
FIG. 6 is a block diagram of a printer control unit in the transfer type ink jet recording apparatus shown in FIG. 1.

FIG. 6 is a block diagram of the printer control unit in the transfer type ink jet recording apparatus in FIG. 1.

401 is a CPU for controlling the whole printer, 402 is a ROM for storing a control program for the CPU, and 403 is a RAM for executing a program. 404 is an application specific integrated circuit (ASIC) including a network controller, a serial IF controller, a controller for generating head data, a motor controller, and the like. 405 is a conveyance control unit for a liquid absorbing member for driving a conveyance motor 406 for a liquid absorbing member and is controlled by a command from the ASIC 404 via a serial IF. 407 is a transfer body drive control unit for driving a transfer body drive motor 408 and is also controlled by a command from the ASIC 404 via a serial IF. 409 is a head control unit and performs final discharge data generation for the ink jet device 305 and drive voltage generation, for example.

(Direct Drawing Type Ink Jet Recording Apparatus)

As another embodiment of the present invention, a direct drawing type ink jet recording apparatus is exemplified. In the direct drawing type ink jet recording apparatus, the ink receiving medium is a recording medium on which an image is to be formed.

FIG. 2 is a schematic view showing an exemplary schematic structure of a direct drawing type ink jet recording apparatus 200 in the embodiment. As compared with the above transfer type ink jet recording apparatus, the direct drawing type ink jet recording apparatus includes the same units as the transfer type ink jet recording apparatus with the exception that the transfer body 101, the support member 102, and the cleaning member 109 for a transfer body are not included, and an image is formed on a recording medium 208.

Hence, a reaction liquid applying device 203 for applying a reaction liquid onto the recording medium 208, an ink applying device 204 for applying an ink onto the recording medium 208, and a liquid absorbing device 205 including a liquid absorbing member 205*a* that comes into contact with a first image on the recording medium 208 to absorb a liquid component contained in the first image have the same structures as those in the transfer type ink jet recording apparatus, and are not described.

In the direct drawing type ink jet recording apparatus of the embodiment, the liquid absorbing device 205 includes the liquid absorbing member 205*a* and a pressing member 205*b* for liquid absorption that presses the liquid absorbing member 205*a* against the first image on the recording medium 208. The liquid absorbing member 205*a* and the pressing member 205*b* may have any shape, and members having substantially the same shapes as those of the liquid absorbing member and the pressing member usable in the transfer type ink jet recording apparatus can be used. The liquid absorbing device 205 may further include extending members for extending the liquid absorbing member. In FIGS. 2, 205*c*, 205*d*, 205*e*, 205*f*, and 205*g* are extending rollers as the extending members. The number of extending rollers is not limited to 5 as shown in FIG. 2, and an intended number of rollers can be arranged depending on the design of an apparatus. The direct drawing type ink jet recording apparatus may further include recording medium support members, not shown in the drawings, for supporting the recording medium from below, at a position opposed to an ink applying unit including the ink applying device 204 for applying an ink to the recording medium 208 and a position opposed to a liquid component removing unit including the liquid absorbing member 205*a* that comes into pressure contact with a first image on the recording medium to remove a liquid component.

<Recording Medium Conveyance Device>

In the direct drawing type ink jet recording apparatus of the embodiment, a recording medium conveyance device 207 is not limited to particular devices, and a conveyance device in a known direct drawing type ink jet recording apparatus can be used. As shown in FIG. 2, a recording medium conveyance device including a recording medium delivery roller 207*a*, a recording medium winding roller 207*b*, and recording medium conveyor rollers 207*c*, 207*d*, 207*e*, and 207*f* is exemplified.

<Control System>

The direct drawing type ink jet recording apparatus in the embodiment has a control system for controlling each device. A block diagram of the control system for the whole direct drawing type ink jet recording apparatus shown in FIG. 2 is as shown in FIG. 7 as with the transfer type ink jet recording apparatus shown in FIG. 1.

Figure 7:
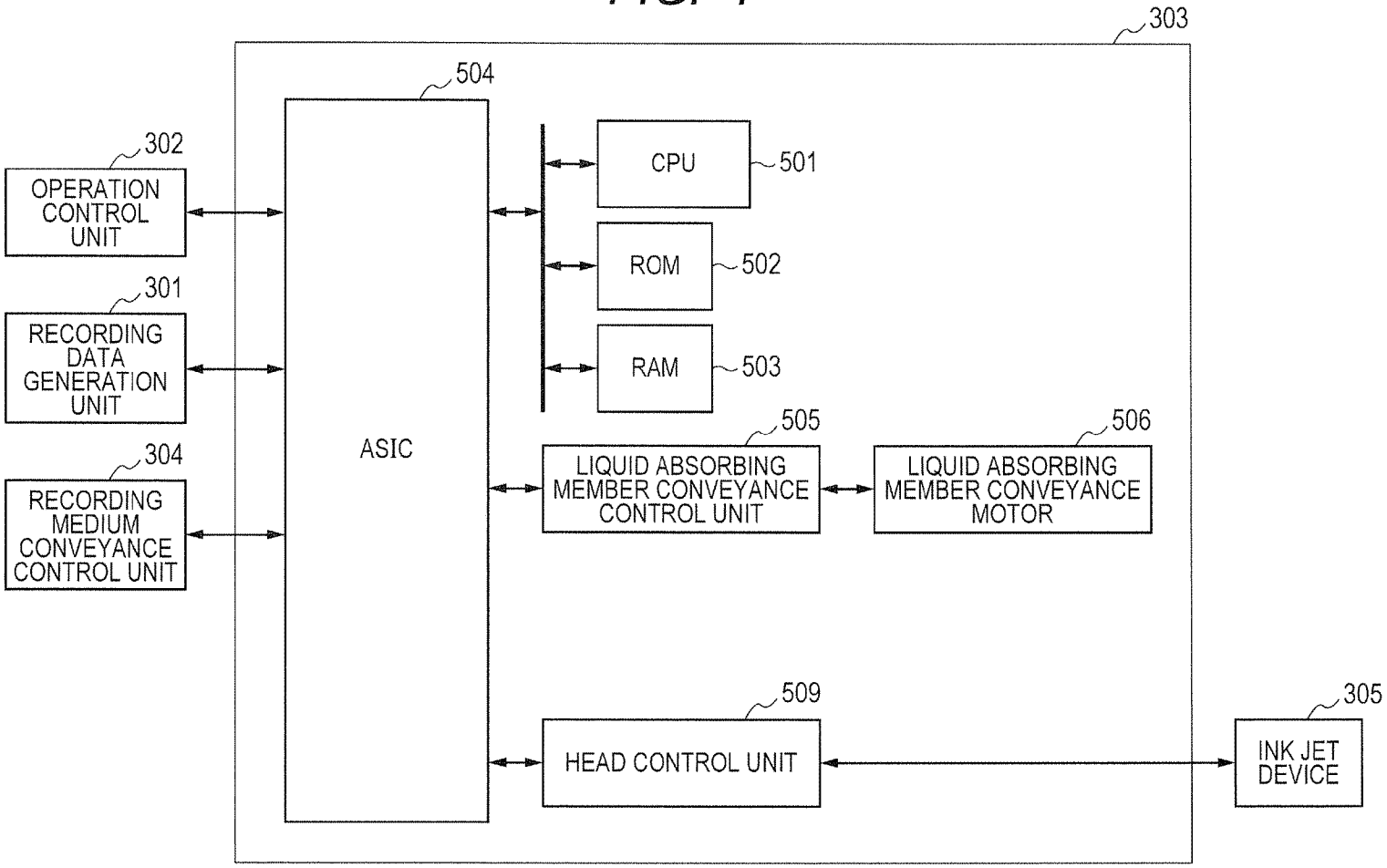
FIG. 7 is a block diagram of a printer control unit in the direct drawing type ink jet recording apparatus shown in FIG. 2.

FIG. 7 is a block diagram of the printer control unit in the direct drawing type ink jet recording apparatus in FIG. 2. The block diagram is the same as the block diagram of the printer control unit in the transfer type ink jet recording apparatus in FIG. 6 with the exception that the transfer body drive control unit 407 and the transfer body drive motor 408 are not included.

In other words, 501 is a CPU for controlling the whole printer, 502 is a ROM for storing a control program for the CPU, and 503 is a RAM for executing a program. 504 is an ASIC including a network controller, a serial IF controller, a controller for generating head data, a motor controller, and the like. 505 is a conveyance control unit for a liquid absorbing member for driving a conveyance motor 506 for a liquid absorbing member and is controlled by a command from the ASIC 504 via a serial IF. 509 is a head control unit and performs final discharge data generation for the ink jet device 305 and drive voltage generation, for example.

Information about the paper type can be obtained by comparison of data such as surface roughness and basis weight (weight) with previously stored library data or by information input from a user interface.

According to embodiments of the present invention, an ink jet recording apparatus and an ink jet recording method capable of efficiently removing a liquid component from images when a porous body is brought into contact with an image to remove the liquid component from the image can be provided.

EXAMPLES

The present invention will be described below in further detail with reference to examples and comparative examples. The present invention is not intended to be limited to the following examples without departing from the scope of the invention. In the following description in examples, "part" is based on mass unless otherwise noted.

Example 1

In the present example, the transfer type ink jet recording apparatus shown in FIG. 1 was used.

The transfer body 101 in the present example is fixed to the surface of the support member 102 with an adhesive. In the example, a PET sheet having a thickness of 0.5 mm was coated with a silicone rubber (KE12 (trade name), manufactured by Shin-Etsu Chemical) into a thickness of 0.3 mm, and the resulting sheet was used as the elastic layer of the transfer body 101. Glycidoxypropyltriethoxysilane and methyltriethoxysilane were mixed at a molar ratio of 1:1, and the mixture was heated and refluxed to give a condensate. The condensate was mixed with a photocationic polymerization initiator (SP150 (trade name), manufactured by ADEKA) to give a mixture. Atmospheric pressure plasma treatment was performed so that the elastic layer surface would have a contact angle with water of 10° or less. The above mixture was applied onto the elastic layer and subjected to UV irradiation (with a high-pressure mercury lamp in an integrated exposure amount of 5,000 mJ/cm$^2$) and to thermal curing (150° C., 2 hours) to form a film, yielding a transfer body 101 including the elastic body on which a surface layer having a thickness of 0.5 μm was formed.

In the constitution, a double-sided adhesive tape, which is not shown in the drawings for simple explanation, was used between the transfer body 101 and the support member 102 for holding the transfer body 101.

In the constitution, the surface of the transfer body 101 was heated at 60° C. by a heating unit not shown in the drawings.

As the ink applying device 104, an ink jet recording head including an electrothermal converter for discharging an ink on demand was used, and the ink application amount was 20 g/m$^2$.

The liquid absorbing member 105*a* is controlled by conveyor rollers 105*c*, 105*d*, and 105*e*, which extend and convey the liquid absorbing member, so as to have substantially the same speed as the movement speed of the transfer body 101. The recording medium 108 is conveyed by the recording medium delivery roller 107*a* and the recording medium winding roller 107*b* so as to be substantially the same speed as the movement speed of the transfer body 101. In the example, the conveyance speed was 0.5 m/s, and Aurora Coat Paper (trade name; manufactured by Nippon Paper Industries; basis weight: 104 g/m$^2$) was used as the recording medium 108.

[Preparation of Reaction Liquid]

As the reaction liquid to be applied by a reaction liquid applying device 103, the reaction liquid having the following formulation was used. The amount of the reaction liquid applied by the reaction liquid applying device 103 was 1 g/m$^2$.

Glutaric acid: 21.0 parts
Glycerol: 5.0 parts
Surfactant (trade name: MEGAFACE F444, manufactured by DIC Corporation): 5.0 parts
Ion-exchanged water: remainder

[Preparation of Ink]

An ink was prepared by the following procedure.

<Preparation of Pigment Dispersion>

First, 10 parts of carbon black (trade name: Monarch 1100, manufactured by Cabot), 15 parts of a resin aqueous solution (prepared by neutralizing a 20.0% by mass aqueous solution of styrene-ethyl acrylate-acrylic acid copolymer having an acid value of 150 and a weight average molecular weight (Mw) of 8,000 with an aqueous potassium hydroxide), and 75 parts of pure water were mixed. The mixture was placed in a batch type vertical sand mill (manufactured by Aimex), and 200 parts of 0.3-mm zirconia beads were added. The mixture was dispersed for 5 hours while being cooled with water. The dispersion liquid was centrifuged to remove coarse particles, and a black pigment dispersion having a pigment content of 10.0% by mass was prepared. The pigment had an average particle diameter of 80 nm.

<Preparation of Resin Particle Dispersion>

First, 20 parts of ethyl methacrylate, 3 parts of 2,2'-azobis-(2-methylbutyronitrile), and 2 parts of n-hexadecane were mixed, and the mixture was stirred for 0.5 hour. The mixture was added dropwise to 75 parts of 8% aqueous solution of styrene-butyl acrylate-acrylic acid copolymer (acid value: 130 mg KOH/g, weight average molecular weight (Mw): 7,000), and the whole was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin particle dispersion having a resin content of 25.0% by mass. The resin particles had an average particle diameter of 240 nm.

<Preparation of Ink>

The resin particle dispersion and the pigment dispersion prepared above were mixed with the components shown below. The remainder of ion-exchanged water is such an amount that the total amount of all the components constituting the ink will be 100.0% by mass.

Pigment dispersion (pigment having an average particle diameter of 80 nm): 10 parts Resin particle dispersion (resin particles having an average particle diameter of 240 nm): 40 parts Glycerol: 7 parts Polyethylene glycol (number average molecular weight (Mn): 1,000): 3 parts Surfactant: Acetylenol E100 (trade name, manufactured by Kawaken Fine Chemicals): 1 part Ion-exchanged water: remainder The components were thoroughly stirred and dispersed and then subjected to pressure filtration through a microfilter with a pore size of 3.0 μm (manufactured by Fujifilm), giving a black ink.

In the present invention, the average particle diameter of first particles (particles having smaller diameters, a pigment or resin particles in the example and comparative examples) is defined as D1, the average particle diameter of second particles (particles having larger diameters, a pigment or resin particles in the example and comparative examples) is defined as D2, the first particle amount is defined as M1, the second particle amount is defined as M2, the particle diameter ratio is defined as D1/D2, and the particle amount ratio is defined as M1/M2. The ink of Example 1 was observed under a scanning electron microscope (S4800 (trade name), manufactured by Hitachi High-Technologies Corporation; magnification: 50 K), giving a particle diameter ratio D1/D2 of 0.3 and a particle amount ratio M1/M2 of 0.2. In Examples 1 to 7 and Comparative Examples 1 to 7, each ink was directly observed with a scanning electron microscope, giving D1, D2, M1, and M2. In Examples 8 and 9, the respective pigment dispersions and the resin particle dispersions used for preparing the inks were separately observed, giving D1, D2, M1, and M2.

[Liquid Absorbing Member]

In the present example, emulsion polymerized PTFE particles were compression molded, then the molded product was fibrillated by drawing at a temperature not higher than the melting point, and the resulting porous PTFE film having an average pore diameter of 0.2 μm was used as the liquid absorbing member.

The porous film had a Gurley value of 5 seconds. The liquid absorbing member was immersed in a wetting liquid composed of 95 parts of ethanol and 5 parts of water, and the impregnated wetting liquid was replaced with 100 parts of water. The liquid absorbing member 105*a* after the treatment was used for liquid removal from first images. The liquid absorbing member 105*b* is pressed so that the average nip pressure between the transfer body 101 and the liquid absorbing member 105*a* will be 3 kg/cm$^2$. The pressing member 105*b* used in the liquid absorbing unit had a roller diameter of ϕ200 mm.

[Evaluation]

Evaluations were performed by the following evaluation method. The evaluation results are shown in Table 1.

In the present invention, criteria A and B in the evaluation item are preferred levels, and criterion C is an unacceptable level. In the evaluation, a liquid was removed from an image, and the liquid component removal rate was evaluated. The liquid component removal rate was calculated from ink placing amount W1, transfer body weight W2 in an ink placing region, and transfer body weight W3 in the ink placing region after liquid component removal.

Expression (3) for calculating the liquid component removal rate and criteria are shown below.

$$\text{Liquid component removal rate [\%]}=\{(W1+W2-W3)/W1\}\times 100 \quad (3)$$

(Criteria)

A more preferred level when the liquid component removal rate is not less than 85%: A A preferred level when the liquid component removal rate is less than 85% and not less than 70% or more: B An unacceptable level when the liquid component removal rate is less than 70%: C

Examples 2 to 9

Other examples are as shown below. The evaluation results are shown in Table 1.

In Examples 2 and 3, the process was performed in the same manner as in Example 1 with the exception that the average particle diameters of the first particles and the second particles were changed by controlling production conditions, and the liquid component removal rates were evaluated.

In Examples 4 and 5, the process was performed in the same manner as in Example 1 with the exception that the contact pressure between the porous body and the recording medium was changed, and the liquid component removal rates were evaluated.

In Examples 6 and 7, the process was performed in the same manner as in Example 1 with the exception that the contents of the first particles and the second particles were changed, and the liquid component removal rates were evaluated.

In Example 8, the process was performed in the same manner as in Example 1 with the exception that the same resin particles as the second particles except the average particle diameter were prepared as the first particles in place of the pigment and two types of resin particles different in average particle diameter were used, and the liquid component removal rate was evaluated.

In Example 9, the process was performed in the same manner as in Example 1 except that the same pigment as the pigment, which was the first particles, except the average particle diameter was prepared as the second particles in place of the resin particles and two types of pigments different in average particle diameter were used, and the liquid component removal rate was evaluated.

Comparative Examples 1 to 7

In Comparative Examples 1 and 3, the process was performed in the same manner as in Example 1 with the exception that the average particle diameter of the second particles was changed by controlling production conditions, and the liquid component removal rates were evaluated.

In Comparative Example 2, the process was performed in the same manner as in Example 1 with the exception that the average particle diameter of the first particles was changed by controlling production conditions, and the liquid component removal rate was evaluated.

In Comparative Example 4, the process was performed in the same manner as in Comparative Example 1 with the exception that the contents of the first particles and the second particles were changed, and the liquid component removal rate was evaluated.

In Comparative Example 5, the process was performed in the same manner as in Comparative Example 3 with the exception that the contents of the first particles and the second particles were changed, and the liquid component removal rate was evaluated.

In Comparative Example 6, the process was performed in the same manner as in Example 1 with the exception that the second particles were not used, and the liquid component removal rate was evaluated.

In Comparative Example 7, the process was performed in the same manner as in Example 1 with the exception that the first particles were not used, and the liquid component removal rate was evaluated.

TABLE 1

| | Average particle diameter of pigment (first particles) D1 | Average particle diameter of second particles D2 | Particle diameter ratio D1/D2 | Particle content ratio M1/M2 | Applied pressure | Liquid component removal rate |
|---|---|---|---|---|---|---|
| Example 1 | Φ80 nm | Φ240 nm | 0.3 | 0.2 | 3 kg/cm$^2$ | A |
| Example 2 | Φ100 nm | Φ240 nm | 0.4 | 0.2 | 3 kg/cm$^2$ | A |
| Example 3 | Φ80 nm | Φ160 nm | 0.5 | 0.2 | 3 kg/cm$^2$ | A |
| Example 4 | Φ80 nm | Φ240 nm | 0.3 | 0.2 | 1.5 kg/cm$^2$ | A |
| Example 5 | Φ80 nm | Φ240 nm | 0.3 | 0.2 | 1 kg/cm$^2$ | B |
| Example 6 | Φ80 nm | Φ240 nm | 0.3 | 0.4 | 3 kg/cm$^2$ | A |
| Example 7 | Φ80 nm | Φ240 nm | 0.3 | 0.6 | 3 kg/cm$^2$ | A |
| Example 8 | — | Φ80 nm(D1)/ Φ240 nm(D2) | 0.3 | 0.2 | 3 kg/cm$^2$ | A |
| Example 9 | Φ80 nm(D1)/ Φ240 nm(D2) | — | 0.3 | 0.2 | 3 kg/cm$^2$ | A |
| Comparative Example 1 | Φ80 nm | Φ80 nm | 1 | 0.2 | 3 kg/cm$^2$ | C |
| Comparative Example 2 | Φ240 nm | Φ240 nm | 1 | 0.2 | 3 kg/cm$^2$ | C |
| Comparative Example 3 | Φ80 nm | Φ160 nm | 0.5 | 0.1 | 3 kg/cm$^2$ | C |
| Comparative Example 4 | Φ80 nm | Φ80 nm | 1 | 1 | 3 kg/cm$^2$ | C |
| Comparative Example 5 | Φ240 nm | Φ240 nm | 1 | 1 | 3 kg/cm$^2$ | C |
| Comparative Example 6 | Φ80 nm | — | — | — | 3 kg/cm$^2$ | C |
| Comparative Example 7 | — | Φ240 nm | — | — | 3 kg/cm$^2$ | C |

Example 10

Evaluations were performed in the same manner as in Example 1 with the exception that the direct drawing type ink jet recording apparatus shown in FIG. 2 for directly applying a reaction liquid to a recording medium and further applying an ink was used in place of the transfer type ink jet recording apparatus shown in FIG. 1. For the image evaluation by the direct drawing type ink jet recording apparatus shown in FIG. 2, cast-coated paper (GLORIA PURE WHITE (trade name); basis weight: 210 g/m$^2$; manufactured by GOJO PAPER MFG. CO., LTD) was used as the recording medium.

The reaction liquid formulation, the reaction liquid applying device 203, the ink formulation, the ink applying unit 204, the conveyance speed of the recording medium, and the liquid absorbing device 205 were in the same conditions as for the transfer type ink jet recording apparatus used in Example 1 except the recording medium.

Consequently, it was ascertained that the same evaluation result of the liquid component removal rate as Example 1 was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-026418, filed Feb. 15, 2016, which is hereby incorporated by reference herein in its entirety.

What is claimed is:

1. An ink jet recording method comprising:

an image forming step of applying, to an ink receiving medium, (i) an ink containing an aqueous liquid medium and a coloring material, and (ii) a reaction liquid that increases a viscosity of the ink, to form a first image containing an aqueous liquid component and the coloring material; and a liquid absorbing step of bringing a first face of a porous body of a liquid absorbing member into contact with the first image to allow the porous body to absorb at least a part of the aqueous liquid component from the first image, wherein the ink contains at least two or more types of particles different in average particle diameter, wherein the particles different in average particle diameter include first particles and second particles, and wherein the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

2. The ink jet recording method according to claim 1, wherein the liquid absorbing step comprises bringing the porous body into pressure contact with the ink receiving medium to allow the porous body to absorb at least a part of the aqueous liquid component from the first image.

3. The ink jet recording method according to claim 1, wherein a contact pressure P between the ink receiving medium and the porous body satisfies 0.15 [MPa]≤P≤1.0 [MPa].

4. The ink jet recording method according to claim 1, wherein the ink receiving medium is a transfer body configured to temporarily hold the first image and a second image formed by removing at least a part of the aqueous liquid component from the first image, and the ink jet recording method further comprises, after the liquid absorbing step, a step of transferring the second image to a recording medium on which a final image is to be formed.

5. The ink jet recording method according to claim 1, wherein the ink receiving medium is a recording medium on which a final image is to be formed, and the liquid absorbing step is a step of absorbing at least a part of the aqueous liquid component from the first image on the recording medium by the porous body.

6. An ink jet recording apparatus comprising:

an image forming unit including (i) an ink jet recording unit configured to apply an ink containing an aqueous liquid medium and a coloring material to an ink receiving medium, and (ii) a reaction liquid applying unit configured to apply a reaction liquid that increases a viscosity of the ink, the image forming unit being configured to form a first image containing an aqueous liquid component and the coloring material; and a liquid absorbing unit including a liquid absorbing member, the liquid absorbing member including a porous body having a first face configured to come into contact with the first image, the porous body being configured to absorb at least a part of the aqueous liquid component from the first image, wherein the ink contains at least two or more types of particles different in average particle diameter, wherein the particles different in average particle diameter include first particles and second particles, and wherein the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

7. The ink jet recording apparatus according to claim 6, wherein the liquid absorbing unit includes a pressure mechanism configured to bring the porous body into pressure contact with the ink receiving medium.

8. The ink jet recording apparatus according to claim 6, wherein a contact pressure P between the ink receiving medium and the porous body satisfies 0.15 [MPa]≤P≤1.0 [MPa].

9. The ink jet recording apparatus according to claim 6, wherein the ink receiving medium is a transfer body configured to temporarily hold the first image and a second image formed by removing at least a part of the aqueous liquid component from the first image, and the ink jet recording apparatus further comprises a transfer unit configured to transfer the second image to a recording medium on which a final image is to be formed.

10. The ink jet recording apparatus according to claim 6, wherein the ink receiving medium is a recording medium on which a final image is to be formed, and a second image is formed on the recording medium by removing at least a part of the aqueous liquid component from the first image by the liquid absorbing member.

11. An ink jet recording method comprising:

an image forming step of applying, to an ink receiving medium, (i) an ink containing an aqueous liquid medium and a coloring material, and (ii) a reaction liquid that increases a viscosity of the ink, to form a first image containing an aqueous liquid component and the coloring material; and a liquid absorbing step of bringing a first face of a porous body of a liquid absorbing member into contact with the first image to concentrate the ink constituting the first image, wherein the ink contains at least two or more types of particles different in average particle diameter, wherein the particles different in average particle diameter include first particles and second particles, and wherein the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

12. An ink jet recording apparatus comprising:

an image forming unit including (i) an ink jet recording unit configured to apply an ink containing an aqueous liquid medium and a coloring material to an ink receiving medium, and (ii) a reaction liquid applying unit configured to apply a reaction liquid that increases a viscosity of the ink, the image forming unit being configured to form a first image containing an aqueous liquid component and the coloring material; and a liquid absorbing unit including a liquid absorbing member, the liquid absorbing member including a porous body having a first face configured to come into contact with the first image to concentrate the ink constituting the first image, wherein the ink contains at least two or more types of particles different in average particle diameter, wherein the particles different in average particle diameter include first particles and second particles, and wherein the particles satisfy expressions (1) and (2):

$$D1/D2 \leq 0.5 \quad (1)$$

$$0.2 \leq M1/M2 \quad (2)$$

where D1 is an average particle diameter of the first particles, M1 is a content of the first particles in the ink, D2 is an average particle diameter of the second particles, and M2 is a content of the second particles in the ink.

* * * * *